US007860263B2

(12) United States Patent
Fischer

(10) Patent No.: US 7,860,263 B2
(45) Date of Patent: Dec. 28, 2010

(54) HEARING DEVICE AND METHOD FOR REDUCING FEEDBACK THEREIN

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1190 days.

(21) Appl. No.: 11/493,267

(22) Filed: Jul. 25, 2006

(65) Prior Publication Data

US 2007/0030990 A1 Feb. 8, 2007

(30) Foreign Application Priority Data

Jul. 25, 2005 (DE) ..... 10 2005 034 646

(51) Int. Cl.
*H04R 25/00* (2006.01)

(52) U.S. Cl. ..... 381/318; 381/322; 381/324; 381/328

(58) Field of Classification Search ..... 381/312–330
See application file for complete search history.

(56) References Cited

U.S. PATENT DOCUMENTS 5,003,606 A * 3/1991 Bordewijk ..... 381/318
5,033,090 A * 7/1991 Weinrich ..... 381/318
5,121,426 A 6/1992 Baumhauer, Jr. et al.
5,201,006 A * 4/1993 Weinrich ..... 381/318
5,402,496 A 3/1995 Soli et al.
6,072,884 A * 6/2000 Kates ..... 381/318
6,920,227 B2 * 7/2005 Chalupper et al. ..... 381/312
2002/0176594 A1 11/2002 Hohmann et al.
2003/0032856 A1 2/2003 Kroll et al.
2004/0240682 A1 12/2004 Fischer

FOREIGN PATENT DOCUMENTS

JP 05199590 8/1993
JP 2004297304 10/2004
WO WO 2005/029914 3/2005

* cited by examiner

*Primary Examiner*—Curtis Kuntz
*Assistant Examiner*—Ryan Robinson
(74) *Attorney, Agent, or Firm*—Schiff Hardin LLP

(57) ABSTRACT

In a hearing device with low feedback tendency with simultaneous open feed and utilization of the natural directional effect of the pinna, the hearing device has a tube-shaped ear fitting piece for insertion into an auditory canal and speaker is arranged in the ear fitting piece, and at least two microphones are arranged in the ear fitting piece acoustically-symmetrically to the speaker in the built-in state of the hearing device in the ear fitting piece. The sound emitted by the speaker that can be differentiated from the usable sound, such that the level of feedback can be reduced. At the same time, open feed and utilization of the natural directional effect of the pinna are ensured.

4 Claims, 2 Drawing Sheets

HEARING DEVICE AND METHOD FOR REDUCING FEEDBACK THEREIN

BACKGROUND OF THE INVENTION

1. Field of the Invention

The present invention concerns a hearing device and a method for reduction of feedback therein between a speaker and a number of microphones.

2. Description of the Prior Art

In principle it is desirable to achieve together the following properties of a part of a hearing device located in the ear:

- open feed
- utilization of the natural directional effect of the pinna (auricle), i.e. microphone position in the auditory canal
- freedom from feedback, or at least a low feedback tendency in the system.

The desired properties or requirements cited above are conventionally achieved (each separately) according to the following:

- The open feed is achieved with an open ear fitting piece given a behind the ear hearing device (BtE).
- The natural directional effect of the pinna can be achieved by a complete CIC device located in the auditory canal, but a ventilation of the auditory canal can be achieved only with difficulty due to feedback problems.
- The freedom from feedback can be attained by use of a circuit known as a feedback compensator that operates on the principle of counter-phase cancellation of the feedback signal. Due to the relatively high variability and complexity of the feedback path, the effect is conventionally limited to approximately 10 dB to a maximum of 15 dB amplifier gain. In order to achieve this, however, sealing of the auditory canal is generally necessary.

Active noise suppression for a hearing aid device wearable in the ear is known from DE 103 32 119 B3. The device described therein has an additional earpiece that is arranged in a ventilation channel. This additional earpiece is located approximately in the middle of the ventilation channel, and two microphones are located symmetrically to this additional earpiece in the ventilation channel. One of the two microphones and the earpiece serve to prevent direct noise in the auditory canal and the additional microphone, together with the earpiece, serves to prevent feedback.

Furthermore, a noise suppression arrangement with focused adaptive filtering for hearing prostheses is known from DE 693 27 992 T2. The feedback suppression arrangement described therein has two microphones as well as a speaker.

SUMMARY OF THE INVENTION

An object of the present invention is to provide a hearing device with low feedback tendency, wherein the directional effect of the pinna also is utilized and an open feed also is ensured.

According to the invention, this object is achieved by a hearing device with a tube-shaped ear fitting piece for insertion into an auditory canal, a speaker that is arranged in the ear fitting piece, a first microphone and at least one second microphone, and a signal processing unit, whereby. In the built-in state of the hearing device in the ear fitting piece, the (at least) two microphones are arranged acoustically-symmetrically to the speaker; a microphone matching unit with which differences of the microphone signals of the at least two microphones can be established is connected to the microphones.

Only those portions of the microphone signal that are acquired differently in the at least two microphones at a given point in time are processed with the signal processing unit connected to the microphone matching unit, and are conducted therefrom to the speaker.

Moreover, according to the invention a method is provided for reduction of feedback in a hearing device (in particular in a hearing apparatus) by emission of sound in an auditory canal at a first location; acquisition of a sound at least one second location and third location in the auditory canal, that are placed acoustically-symmetrical to the first location in the auditory canal, and wherein the acquired sound includes the emitted sound and sound penetrating into the auditory canal from the outside. Essentially only those sound portions of the acquired sound that are different at the second and third locations at a given point in time are amplified for the subsequent signal processing.

The acquisition of the sound at acoustically-symmetrical locations relative to the speaker means it is achieved that the sound signals incident on the microphones are subjected to the same transfer function, such that the sound originating from the speaker can be differentiated from the sound coming from the outside. The three properties cited above thus can be together fulfilled simultaneously: open feed, utilization of the natural directional effect of the pinna, and low feedback tendency.

The hearing device is preferably a hearing apparatus. This means that the tube-shaped ear fitting piece is, for example, part of an otoplastic for a BtE (behind the ear) or part of an ItE (in the ear) hearing apparatus.

In an embodiment of a hearing device has an amplification device with which sound that penetrates into the ear fitting piece from the outside can be amplified differently than sound that originates from the speaker. This means that a signal processing unit includes in the amplification device that separates the individual sound sources such that feedback is prevented insofar as possible.

In a further embodiment of a hearing device according to the invention, comprise a third microphone is provided to detect sound that is reflected by the eardrum. This third microphone is thus placed in the auditory canal or in the ear fitting piece so that the multiple microphones attain a directional effect in the direction of the auditory canal axis. From which direction the sound arrives thus can be calculated.

DESCRIPTION OF THE PREFERRED EMBODIMENTS

Figure 1:
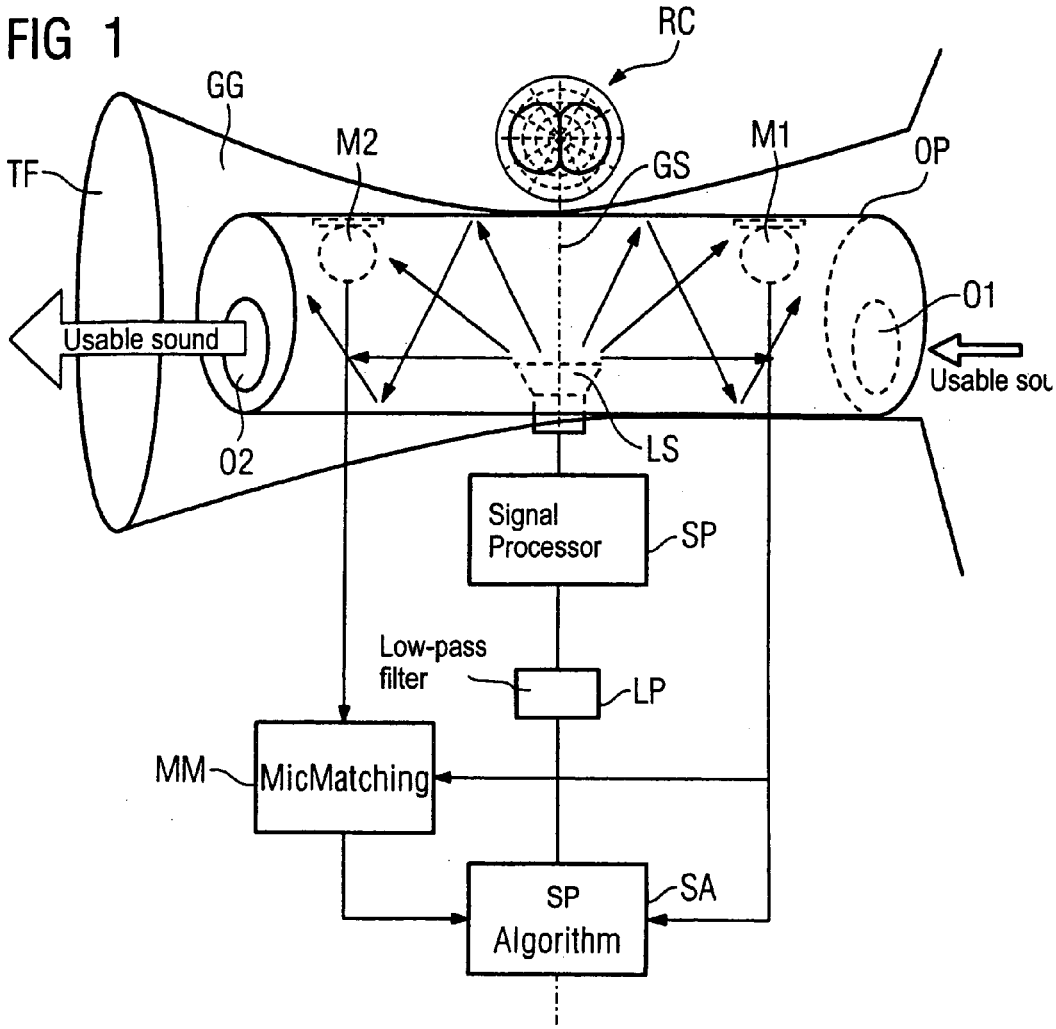
FIG. 1 schematically illustrates an embodiment of an inventive hearing device with two microphones.

In a first embodiment according to FIG. 1, the hearing device has a tube-shaped ear fitting piece OP. This ear fitting piece OP has an opening O1 at its exterior-facing side and an opening O2 at its side that faces the inner ear, when inserted in the auditory canal GG. A cylindrical hollow chamber in which a speaker LS is centrally located is fashioned inside the ear fitting piece OP. The primary radiation (emission) direction of the speaker LS is situated perpendicular to the longitudinal axis of the ear fitting piece OP. Two microphones M1 and M2 are arranged inside the ear fitting piece OP acoustically-symmetrically to the speaker LS. "Acoustically-symmetrical" means that the sound from the speaker LS to the microphone M1 is subjected to the same transfer function as the sound from the speaker LS to the microphone M2. Propagation directions of the sound from the speaker LS are indicated by simple arrows in FIG. 1.

A geometric symmetry line GS is also shown in FIG. 1, the geometric symmetry line GS being defined by the speaker LS and relative to which the microphones M1 and M2 are symmetrically arranged. The acoustic symmetry, however, deviates from the geometric symmetry somewhat because the hearing device respectively, the ear fitting piece OP thereof is located in the auditory canal GG that is sealed by the eardrum TF. A sealed chamber thereby results at one end of the ear fitting piece OP, while the space at the other end of the ear fitting piece OP is open. This asymmetry requires a geometric asymmetry of the locations of the microphones M1, M2 relative to the speaker LS. The amplitude response and phase response of the sound from the speaker LS are the same at both microphones M1 and M2 given the acoustically-symmetrical arrangement. For simplicity, however, the microphones M1 and M2 are shown at geometrically symmetrical locations in FIG. 1.

The specific arrangement of both microphones M1, M2 and of the earpiece or speaker LS in the tube-shaped ear fitting piece OP enables signal processing algorithms to be used that prevent the occurrence of feedback in spite of—or precisely due to—the spatial proximity of the microphones M1 and M2 and the speaker LS. The cause in particular lies in the clear definition of the feedback path. (It should be noted that the term "feedback" is used herein generically, and encompasses feedback individually occurring along respective, different feedback paths.)

The basis behind the invention is to symmetrically arrange multiple microphones in an ear fitting piece that is open at both ends. As is known from directional microphone technology, it is then possible to separate sounds that arrive simultaneously at both microphones from sounds that exhibit a certain delay between their incidence at the microphones. A similar type of the processing is now also applied herein to the microphone signals acquired by the microphones M1 and M2. Since no further sound sources are located within the tube of the ear fitting piece OP, the sound from the speaker LS can be differentiated from sound arriving from the outside i.e., usable sound (see double arrows in FIG. 1). The sound from the speaker LS can be substantially completely removed from the total signal that is subsequently amplified and processed.

Figure 2:
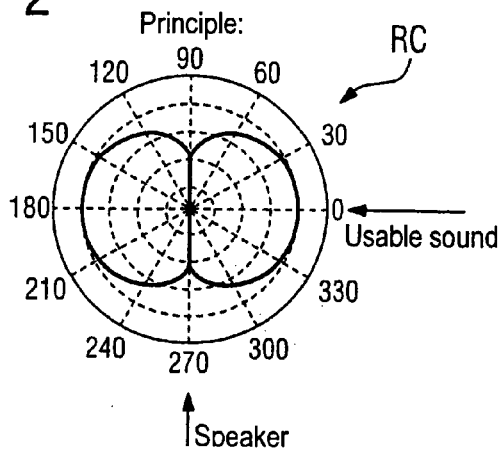
FIG. 2 is a directional chart showing the incident sound directions for the device of FIG. 1.

FIG. 2 shows the directional characteristic RC of the microphone arrangement from FIG. 1 for the middle of the ear fitting piece OP in which the speaker LS is located. The highest attenuation accordingly results in the 90° and 270° directions along which the speaker LS is located, and from which the sound of the speaker LS arrives. By contrast, the usable sound that arrives from the 0° direction is acquired nearly without attenuation. This directional characteristic RC is also indicated in FIG. 1 in the middle of the ear fitting piece OP.

The basic signal processing that is typical for a hearing apparatus is also indicated in FIG. 1. The signals of the microphones M1 and M2 are accordingly subjected to microphone matching MM in which an adaptation of amplitude response and phase response of the signals ensues. A downstream signal processing algorithm SA that also uses the signal of the microphone M1 for processing generates the desired directional effect. The resulting signal is supplied to the speaker LS via a low-pass filter LP and a signal processor SP.

Figure 3:
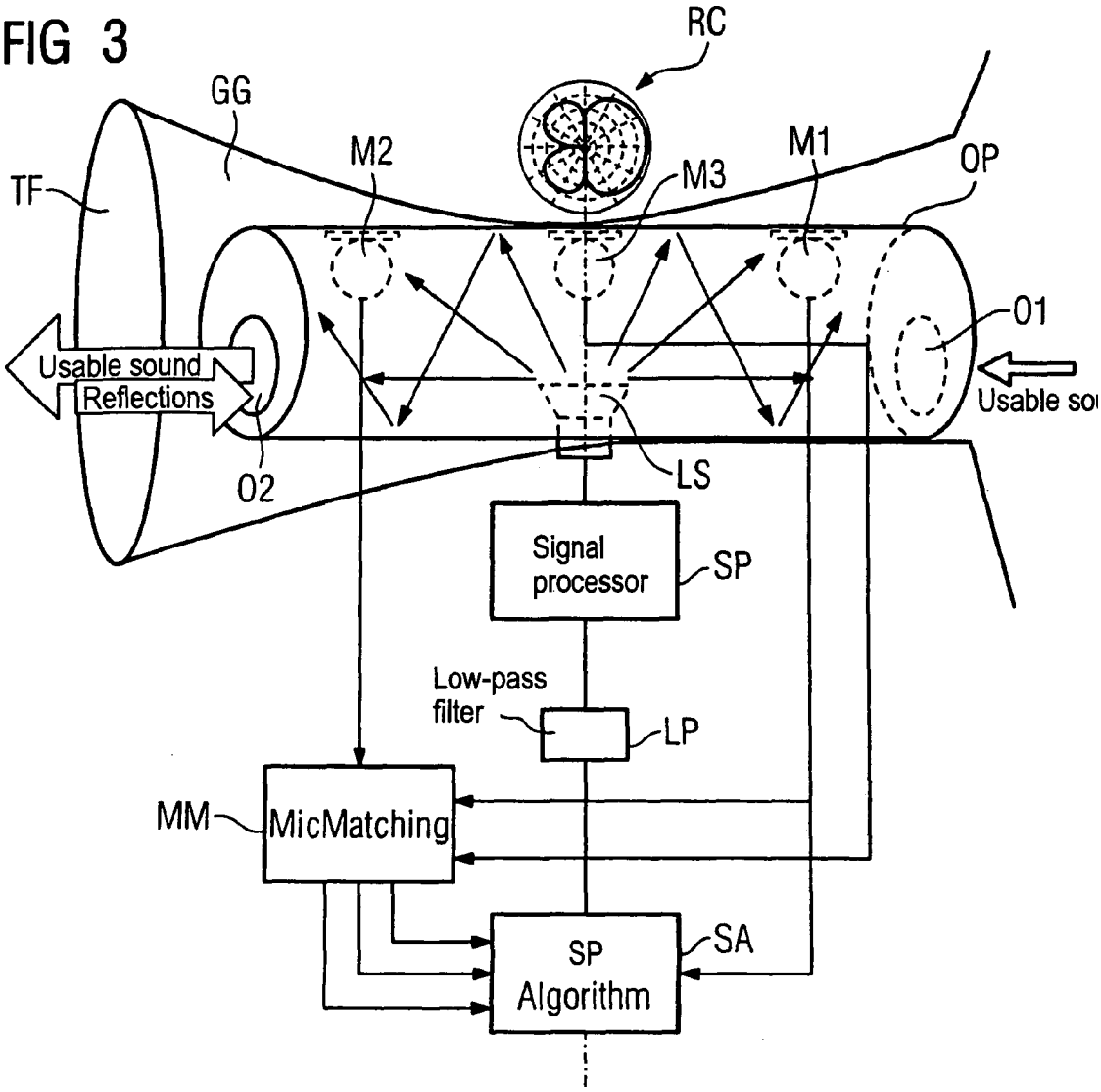
FIG. 3 schematically illustrates an embodiment of an inventive hearing device with three microphones for suppression of reflections.

When the usable signal arrives through the ear fitting piece OP at the eardrum, a portion thereof is reflected back toward the ear fitting piece OP (see FIG. 3). These reflections can also lead to interfering feedback. An additional third microphone M3 therefore is provided in the further embodiment of the hearing device according to FIG. 3. The remaining arrangement of the microphones M1 and M2 as well as of the speaker LS essentially corresponds to that of FIG. 1.

The microphone matching unit MM adapts the amplitude and phase responses of the respective microphone signals to one another and thus establishes differences therebetween. Subsequent signals that exhibit a propagation direction from the eardrum TF to the opening O1 of the ear fitting piece OP directed outwardly can be removed from the usable signal by the signal processing unit SA. At least three microphone input signals are necessary for this purpose. The speaker LS is then supplied with the reflection-free usable signal.

Figure 4:
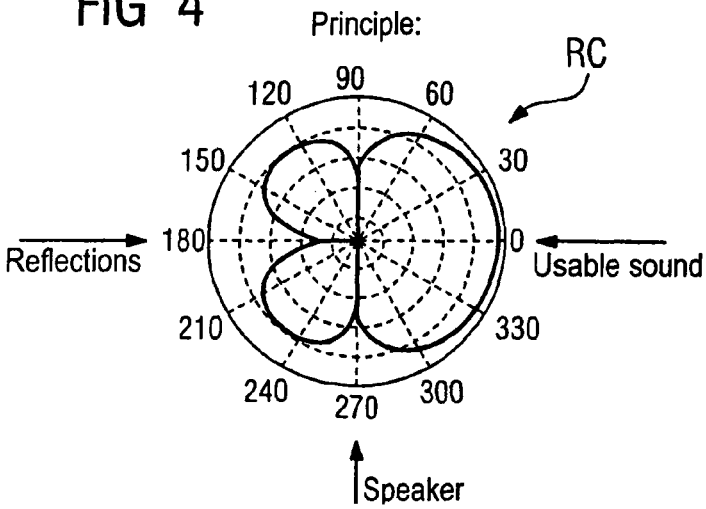
FIG. 4 is a directional chart showing incident sound directions with regard to the device of FIG. 3.

FIG. 4 shows the directional characteristic RC of the microphone arrangement of the hearing device of FIG. 3. High degrees of attenuation accordingly result not only from the direction of the speaker LS but also from the reflection direction, while the usable sound is acquired practically unattenuated. This directional characteristic is also indicated in FIG. 3 for the middle of the ear fitting piece OP.

As already mentioned, the design of a hearing device shown in FIGS. 1 and 3 can be realized both for an ear fitting piece and for a complete in the ear hearing device. In any case, this design enables an open feed, utilization of the natural pinna directional effect and a low feedback tendency.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing device comprising:

an ear fitting piece adapted for insertion into an auditory canal, said ear fitting piece having a tube therein that proceeds into the auditory canal when said ear fitting piece is inserted in the auditory canal;

a speaker disposed in said ear fitting piece, said speaker emitting an audio signal into said tube;

a first microphone and at least one second microphone disposed acoustically-symmetrically relative to said speaker in said ear fitting piece when said ear fitting piece is inserted in the auditory canal, said first and second microphones respectively detecting sound in said tube at acoustically symmetrical locations relative to said speaker;

a microphone matching unit connected to said first and second microphones to receive microphone signals therefrom, and that detects a difference between the respective microphone signals;

a signal processing unit connected to said speaker that supplies a processed signal to said speaker for emission by said speaker as said audio signal; and said microphone matching unit being connected between said first and second microphones and said signal processing unit and supplying only components of the respective microphone signals that were acquired differently by the respective first and second microphones at a any one point in time to said signal processing unit for processing therein to form said processed signal.

2. A hearing device as claimed in claim 1 embodied in a hearing apparatus selected from the group consisting of in the ear and behind the ear hearing aids.

3. A hearing device as claimed in claim 1 comprising an amplification device that amplifies sound penetrating into said ear fitting piece from an exterior of said ear fitting piece differently than said audio signal originating from said speaker.

4. A hearing device as claimed in claim 1 comprising a third microphone disposed to detect sound reflected by the eardrum in the auditory canal, said third microphone also being connected to said microphone matching unit and said microphone matching unit establishing differences between the respective microphone signals of said first, second and third microphones, and supplying only components of microphone signals to said signal processing unit that were acquired differently in said first, second and third microphones at a particular point in time.

* * * * *